United States Patent [19]

Barker

[11] Patent Number: 5,076,971

[45] Date of Patent: Dec. 31, 1991

[54] METHOD FOR ENHANCING ALPHA DECAY IN RADIOACTIVE MATERIALS

[75] Inventor: William A. Barker, Los Altos, Calif.

[73] Assignee: Altran Corporation, Sunnyvale, Calif.

[21] Appl. No.: 400,180

[22] Filed: Aug. 28, 1989

Related U.S. Application Data

[63] Continuation of Ser. No. 112,854, Oct. 23, 1987, abandoned.

[51] Int. Cl.[5] ..... G21F 9/00; G21F 19/42; G21G 1/00; G21G 1/12

[52] U.S. Cl. ..... 252/626; 252/627; 376/156; 376/157; 376/180; 376/182; 376/190; 376/308

[58] Field of Search ..... 376/156, 157, 157, 170, 376/171, 172, 180, 181, 182, 190, 191, 194, 196, 197, 308; 252/625, 626, 627

[56] References Cited

U.S. PATENT DOCUMENTS

| | | | |
|---|---|---|---|
| 2,500,223 | 3/1950 | Wells | 376/156 |
| 3,518,432 | 6/1970 | Uleski | 376/156 |
| 3,974,390 | 8/1976 | Morita et al. | 250/282 |
| 4,364,898 | 12/1982 | Meyer et al. | 376/190 |

FOREIGN PATENT DOCUMENTS

| | | | |
|---|---|---|---|
| 71719/87 | 5/1987 | Australia . | |
| 0012640 | 6/1969 | Japan | 376/158 |
| 0063588 | 5/1977 | Japan | 376/158 |
| 1034539 | 6/1966 | United Kingdom | 376/158 |

OTHER PUBLICATIONS

W. E. Burcham, "Nuclear Physics", McGraw Hill Book Company, Inc., New York (1963), pp. 304–309, 568–569, and 702–703.

E. Segre and C. E. Weigand, "Experiments on the Effect of Atomic Electrons on the Decay Constant on $Be^7$", *Phys. Rev.*, vol. 75, No. 1, Jan. 1949, pp. 39–43.

H. W. Johlige, D. C. Aumann and H. J. Born, "Determination of the Relative Electron Density at the Be Nucleus in Different . . . ", *Phys. Rev.*, vol. 2, No. 5, Nov. 1970, pp. 1616–1622.

R. A. Porter and W. G. McMillen, "Effect of Compression of the Decay Rate of $TC^{99m}$ Metal", *Phys. Rev.*, vol. 117, No. 3, Feb. 1960, pp. 795–800.

Don H. Byers and Robert Stump, "Low-Temperature Influence on the Technetium-99m Lifttime", *Phys. Rev.*, vol. 112, No. 1, Oct. 1958, pp. 77–79.

M. Neve de Mevergnies, "Perturbation of the 235mU Decay Rate by Implanatation in Transition Metals", *Phys. Rev. Ltrs.*, vol. 29, No. 17, Oct. 1972, pp. 1188–1191.

G. Gamow, "Zur Quatentheorie des Atomkernes", *Zeit. f. Phys.*, vol. 1, 1928, pp. 204–212.

R. W. Gurney and E. U. Condon, "Wave Mechanics and Radioactive Disintegration", *Nature*, vol. 122, 1928, p. 439.

R. W. Gurney and E. U. Condon, "Quantum Mechanics and Radioactive Disintegration", *Phys. Rev.*, vol. 33, No. 2, Feb. 1929, pp. 127–140.

E. K. Hyde, I. Perlman and G. T. Seaborg, *Nuclear Properties of the Heavy Elements*, vol. 1, Chap. 1, Prentice Hall, 1964, pp. 16–25.

(List continued on next page.)

*Primary Examiner*—Howard J. Locker

*Attorney, Agent, or Firm*—Skjerven, Morrill, MacPherson, Franklin & Friel

[57] ABSTRACT

Apparatus and method for decontaminating radioactive materials by stimulating the atomic system of radioactive materials. The stimulus is kept applied to the radioactive materials for a predetermined time. In this way, the rate of decay of the radioactivity of the materials is greatly accelerated and the materials are thereby decontaminated at a rate much faster than normal. The stimulus can be applied to the radioactive materials placing them within the sphere or terminal of a Van de Graaff generator and allowing them to be subjected to the electrical potential of the generator, such as in the range of 50 kilovolts to 500 kilovolts, for at least a period of 30 minutes or more.

5 Claims, 2 Drawing Sheets

OTHER PUBLICATIONS

I. Pearlman and J. O. Rasmussen, "Alpha Radioactivity", *Handbuch der Physik*, vol. 42, Springer Verlag, Berlin, 1957, pp. 144–145.

S. Gasiorowicz, *Quantum Physics*, Wiley, N.Y., 1974 ppp. 89–93.

Raumfahrtforschung (5/71), pp. 208–209, Winterberg, "Rocket Propulsion by Thermonuclear Micro-Bombs Ignited with . . . ".

Introduction to Modern Physics (1971), pp. 508–514, J. McGervey Academic Press, N.Y., "Nuclear Transformations".

Physical Review (1/49), vol. 75, No. 1, Segre' et al., "Experiments on the Effect of Atomic Electrons on the Decay Constant . . . ".

METHOD FOR ENHANCING ALPHA DECAY IN RADIOACTIVE MATERIALS

This application is a continuation of application Ser. No. 07/112,854, filed Oct. 23, 1987, (abandoned).

The present invention relates generally to the processing of radioactive materials and, more particularly, to the decontamination of such materials.

BACKGROUND OF THE INVENTION

One of the most important aspects relating to the use of radioactive materials involves the disposal of waste products and by-products of radioactive material processing and use. Some of these waste and by-products can present continuing health hazards if not properly contained.

The length of time necessary for the decay of radioactive materials is typically measured in terms of the "half-life" of the particular decay mechanism. The half-life is a term used to designate the period of time during which one half of the number of original atoms in a given sample will have decayed. Although radioactive decay is a random spontaneous process, its macroscopic properties are mathematically predictable and may be experimentally determined. Thus, the half-life values are relatively well known for most common decay process steps.

The most common radioactive atoms found in waste materials and by-products are two isotopes of uranium, uranium 235 ($_{92}U^{235}$) and uranium 238 ($_{92}U^{238}$), and one of plutonium namely plutonium 239 ($_{92}U^{238}$). These three materials all have, as their primary natural radioactive decay mechanism, the emission of alpha particles. Each of these isotopes will eventually decay to a stable material. The first step in the radioactive decay of plutonium 239 is the emission of an alpha particle to produce uranium 235. Thus both plutonium 239 and uranium 235 will follow the same decay pattern. The eventual resulting stable particle obtained from the decay of uranium 238 is lead 206 ($_{82}Pb^{206}$), while that resulting from the decay of uranium 235 and plutonium 239 is lead 207 (82Pb$^{207}$). The plutonium 239 decay chain embodies 12 steps, the uranium 238 chain as 14 steps, and the uranium 235 has 11 steps. The decay chain mechanisms for these isotopes are shown in Appendix A.

The two principle steps in the decay of the common radioactive isotopes of uranium 235, uranium 238 and plutonium 239 are emission of alpha particles and beta particles from the nucleus. Alpha particle emission occurs when an alpha particle escapes intact from the nucleus of an atom of the unstable material. An alpha particle is comprised of two protons and two neutrons. This particle is a particularly stable configuration in terms of nuclear binding forces. The emission of an alpha particle from a radioactive atom results in the lowering of the atomic number of the atom by two and a lowering of the mass number by four. Beta particle emission results from the spontaneous decay of a neutron to a proton which remains in the nucleus and an electron which is emitted therefrom and an anti-neutrino.

The result of a beta emission from a nucleus is a unit increase in the atomic number of the atom with no change in the atomic mass. For example, one step in the decay of uranium 235 to lead involves the emission of a beta particle from thorium 231 ($_{90}Th^{231}$) to yield protactinium 231 ($_{91}Pa^{231}$). Typically, a given nucleus will decay by either alpha emission, or by beta emission, although some nuclei may decay by other methods, including gamma emission and spontaneous fission. The half-life of beta decay is ordinarily significantly shorter than that for typical alpha decay (see Appendix A).

In the case of the three primary isotopes found in radioactive waste material and by-products, the primary limiting step in the decay is the initial alpha particle emission from the material. The half-lives for these initial decays are extremely long. The initial alpha emission for plutonium 239 has a measured half-life of 24,360 years. Uranium 235 has a half-life of 713 million years, while uranium 238 is the most stable of all, having a half-life or 4.5 billion years. The radioactive content of the waste and by-products of these materials thus remains high over a long period of time.

It is highly desirable to eliminate the radioactivity of waste materials by decontaminating such materials as quickly as possible. Although most alpha decay steps and beta decay steps present no direct hazard, some of these released particles have sufficient energy to cause harm to living things such as animals, persons, and plants. Furthermore, the element plutonium is extremely poisonous. Although relatively harmless when outside of the body, if it is taken into the body by ingestion or through the respiratory track, even a small amount can cause almost immediate death. Plutonium is selectively delivered by the body to the bone marrow, where the alpha emissions can cause significant damage. It has been determined that a dose of 0.6 micrograms of plutonium taken internally is a lethal dose. Thus, plutonium contamination particularly creates a health hazard.

Generally speaking, the scientific community believes that the decay rate of a radioactive nucleus is immutable. However, it is possible to change the decay rate by changing the environment of the emitter. This prior art shows that the decay rate of beta decay and of internal conversion can be changed slightly by varying the chemical composition of an emitter. The present invention is concerned primarily with alpha decay, not investigated by the work of Segre and Wiegand et al, a copy of which was previously made of record. Further the environment change is due to an electrostatic generator. It is not a change in the ambient environment.

According to the accepted theory of beta decay, the decay rate is proportional to $\rho(o)=e\psi^*\psi(o)$, the electron charge density at the nucleus. The decay rate may, therefore, be expected to vary with local changes in the electronic environment. It has been found, for instance, that pressure affects the decay rate. Experiments on beta and gamma decay demonstrate that any rearrangement of the electron charge distribution inside the atom may produce a measurable change in decay rate. In all cases investigated, the effect is extremely small. That is, the increase in decay rate is about 0.1%.

The conventional theory of alpha decay is very well known. The decay is described as the tunneling of an alpha particle through the Coulomb potential barrier of the daughter nucleus. The decay constant is determined by the energy of the alpha particle and by the height and width of the barrier. The theory leads to a relationship between decay rate and the change of the daughter nucleus which fits the data extremely well.

The atomic electrons in an alpha emitter also influence the decay rate. In $Th^{230}$, for example, these electrons generate a constant potential which extends to the nuclear surface, decreasing the height and width of the Coulomb barrier. Although the corresponding potential energy is relatively small, it has a non-trivial effect on the decay constant. In fact, if all of the atomic electrons were stripped off the thorium atom, the half life would be increased from 80,000 to 146,000 years.

Because of the drawbacks of conventional techniques for reducing the hazards of radioactive waste materials, a need exists to accelerate the decontamination of such materials. The present invention satisfies this need.

SUMMARY OF THE INVENTION

The present invention is directed to apparatus and a method for decontaminating radioactive materials. The stimulus is kept applied to the radioactive materials for a predetermined time. In this way, the rate of decay of the radioactivity of the materials is greatly accelerated and the materials are thereby decontaminated at a rate much faster than normal.

The stimulus can be applied to the radioactive materials by placing such materials within the sphere or terminal of a Van de Graaff generator where they are subjected to the electrical potential of the generator, such as in the range of 50 kilovolts to 500 kilovolts, for at least a period of 30 minutes or more.

The present invention is based upon the fact that the decay rate of radioactive materials can be accelerated or enhanced and thereby be controlled by a stimulus, such as an applied electrostatic potential. This potential, for instance, is incorporated into the quantum mechanical tunneling equation for the transmission coefficient T*T by including an additional potential energy $$V_a 2e\phi. \tag{1}$$

where 2e is the charge of the alpha particle. Hence $$T^*T = \exp(-G) \tag{2}$$

where $$G = 2(2\mu/\hbar^2)^{1/2} \int_R^b dr\,(2Z_1e2/r - E + V_a)^{1/2} \tag{3}$$

With $V_a=0$, this expression is well known. Clearly $V_a$ modifies the height and width of the Coulomb barrier. The turning point $$b = 2Z_1e^2/(E - V_a) \tag{4}$$

is greater or less than $b_o = 2Z_1e^2/E$ for $V_a$ positive or negative. Assuming that b is large compared to the nuclear radius, it follows that $$ln\lambda/\lambda_o = 3.71Z_1(E^{-\frac{1}{2}} - (E - V_a)^{-\frac{1}{2}}). \tag{5}$$

where 3.71 is a fit parameter used by Taagepera and Nurmia. It is clear that $V_a$ controls λ. For negative (positive )applied voltages the enhancement $$\epsilon = \Delta\epsilon/\epsilon_o \tag{6}$$

will be positive (negative.

An approximate form for equation (5) is useful when $|V_a| << E$.

$$ln\lambda/\lambda_o = -3.71Z_1e\phi/E^{3/2} \tag{7}$$

In $Th^{230}$ measurements, $|V_a| \leqq 90KeV \sim 2E \times 10^{-2}$. For this isotope, theory predicts a linear relationship between eϕ and $\ln\lambda/\lambda_o$ with a slope of −31.13/MeV.

The primary object of the present invention is to provide an improved apparatus and method for decontaminating radioactive waste materials by providing a stimulus to the materials so that the alpha, beta and gamma particles associated with the materials will decay at an accelerated rate.

Other objects of this invention will become apparent as the following specification progresses, reference being had to the accompanying drawings for an illustration of an apparatus for carrying out the teachings of the invention.

IN THE DRAWINGS

Figure 1:
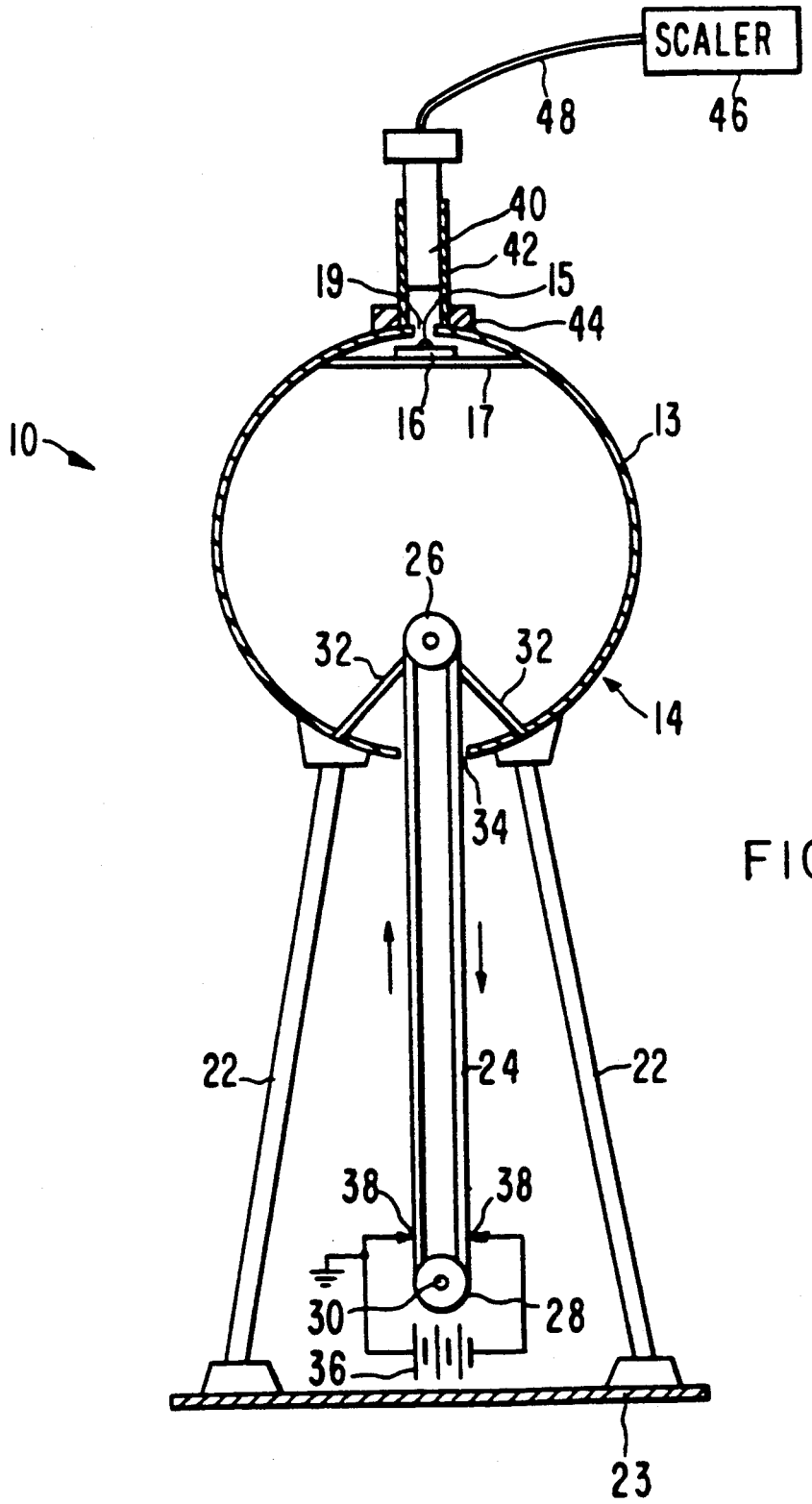
FIG. 1 is a vertical section through a Van de Graaff generator used to show the accelerated decontamination of radioactive materials.

An apparatus for use in showing how various radioactive materials can be decontaminated in accordance with the teachings of the present invention is broadly denoted by the numeral 10 and is shown in FIG. 1. The purpose of the present invention is to stimulate charged particles inside the atomic system of a radioactive material thereby rapidly accelerating the rate of decay of alpha, beta and gamma particles from the material and thereby decontaminating the material.

The decontamination is accomplished in the apparatus of FIG. 1 by the application of a stimulus in the form of a negative electrical charge potential in close proximity to the nucleus of a sample of radioactive material. A large negative potential has the effect of lowering the energy barrier which retains the positively charged particles, such as alpha particles, within the nucleus. As the negative charge potential is placed upon the atomic nuclei, the rate of emission of alpha, beta and gamma particles is increased to thereby accelerate decontamination of the radioactive materials.

Generator 10 includes sphere 13 forming part of a generator mechanism 14. A radioactive sample 15 to be enhanced or decontaminated is placed on a platform 16 supported by a bracket 17 on the interior of sphere 13 near the upper end thereof adjacent to a hole 19 in the sphere. Thus, the radioactive sample is within the sphere and will be subjected to the electrostatic potential generated in the sphere as hereinafter described.

The sphere 13 is supported on legs 22 on a base 23 which is grounded. Thus, the sphere 13 and sample 15 are isolated from external electrical fields.

For generator 10 to operate, sphere 13 must be maintained in spatial and electrical isolation from all other elements including the base plate 23. To this end, legs 22 must be electrical insulators.

Sphere 13 receives electrical charges by way of an insulated moving belt 24 which extends between an interior pulley 26 within sphere 13 and an exterior pulley 28 carried in some suitable manner and on base 23. Drive mechanism 30 is a motor providing rotation of motion to exterior pulley 128.

A high voltage generator is located near pulley 28 near the base plate 23. Generator 36 delivers charges to belt 24 by way of a pair of electrically conducting needles 38 which contact belt 24 on either side of pulley 28. Generator 26 is typically capable of delivering voltages in the range of 50,000 to 500,000 volts.

The purpose of generator 10 is to provide a large negative electrostatic potential with no field at the site of the sample 15. This can be accomplished by placing the sample 15 anywhere within or on the sphere 13.

The radioactive sample 15 can comprise an alpha, beta or gamma emitter. An alpha emitter defining the sample 15 can be, for instance, thorium 230, uranium 235 or plutonium 239. These three sources have half lives of $8\times10^4$ years, $7.1\times10^8$ years and 24,360 years, respectively. There are a few hundred alpha emitters with half lives ranging from less than a millisecond (Fr 215) to billions of years (uranium 238).

Tests were conducted with generator 10 with sample 15 located as shown in FIG. 1. These tests were conducted with the use of a Geiger-Meuller tube 40 adjustably carried by a tube 42 secured by an annular ring 44 to the outer surfaces sphere 13. Tube 42 surrounds hole 19 so that alpha, beta or gamma particles emitted from sample 15 will be directed to tube 40 and sensed thereby. A scalar 46 is coupled by a cable 48 to Geiger-Mueller tube 40.

In the experimental work, three radioactive sources were used as sample 15. The principal source was thorium 230 with an activity of 0.1 ci. As thorium oxide, the sample was electrodeposited and diffusion bonded on platform 17 which, for purposes of illustration, was a 0.001 inch platinum plate in a metal cylinder with a diameter of 24 millimeters and a thickness of three millimeters. This source was made to specification by the Isotope Products Laboratories, of Burbank, Calif. The other sources included a sample of pitchblende obtained from Ward's Natural Science Establishment, and cesium 137 in a cylindrical plastic holder from Nucleus, Inc. of Oak Ridge, Tenn.

The Geiger-Meuller tube 40 and scalar 46 were obtained from Nucleus, Inc. of Oak Ridge, Tenn. The Geiger-Mueller tube (model PK2) detects alpha, beta and gamma particles. The scalar 46 (model 500) was coupled by cable 48 to the Geiger-Mueller tube, the cable being an eight foot coaxial MHP cable to shield the same against the effects of the high voltage generator 10.

Generator 10 was a 250,000 volt generator of negative polarity. It was obtained from Wabash Instrument Company (model N 100-V) of Wabash, Ind. The diameter of sphere 13 of the generator was approximately 25 centimeters.

The sample 15 was housed in a metal clamp inside the sphere 13. This clamp was annular base 44 which can be wood or plastic on the outside of sphere 13. The sensor tube 40 was inserted to various depths into a 3.5 centimeter diameter hole in base 44. The size of hole 19 was 15 millimeters at the top of sphere The voltage achieved with the particular Van de Graaff generator was approximately 50,000 volts. Measurements of the voltage were made from spark lengths by estimating 25,000 volts per inch. A better measure is provided by the source-to-sensor distance. This gives reasonable voltage values if the speed of belt 24 is increased slowly to the point where there is an electron discharge and the scalar goes off scale.

The present invention postulates that an external, electrostatic potential penetrates the interior of the nuclei of a radioactive material to the nuclear well. The material should be an electrical conductor and be housed in a metallic environment. The generator is a simple and convenient high voltage source which acts as a stimulus for accelerated. On the spherical surface of radius a, the voltage is equal to Q/a, where Q is the charge, negative or positive, delivered by the belt. This potential is constant inside the sphere 13 where the electrical field is zero at all locations within the sphere.

A series of experiments were carried out with thorium 230, and the experiments proved to be successful in that a substantial change in activity occurred when the generator 10 was switched from an off condition to an on condition. Over 300 experimental readings were taken which exhibit positive or negative enhancement. Qualitatively, the measurements always agreed with the theory.

Figure 2:
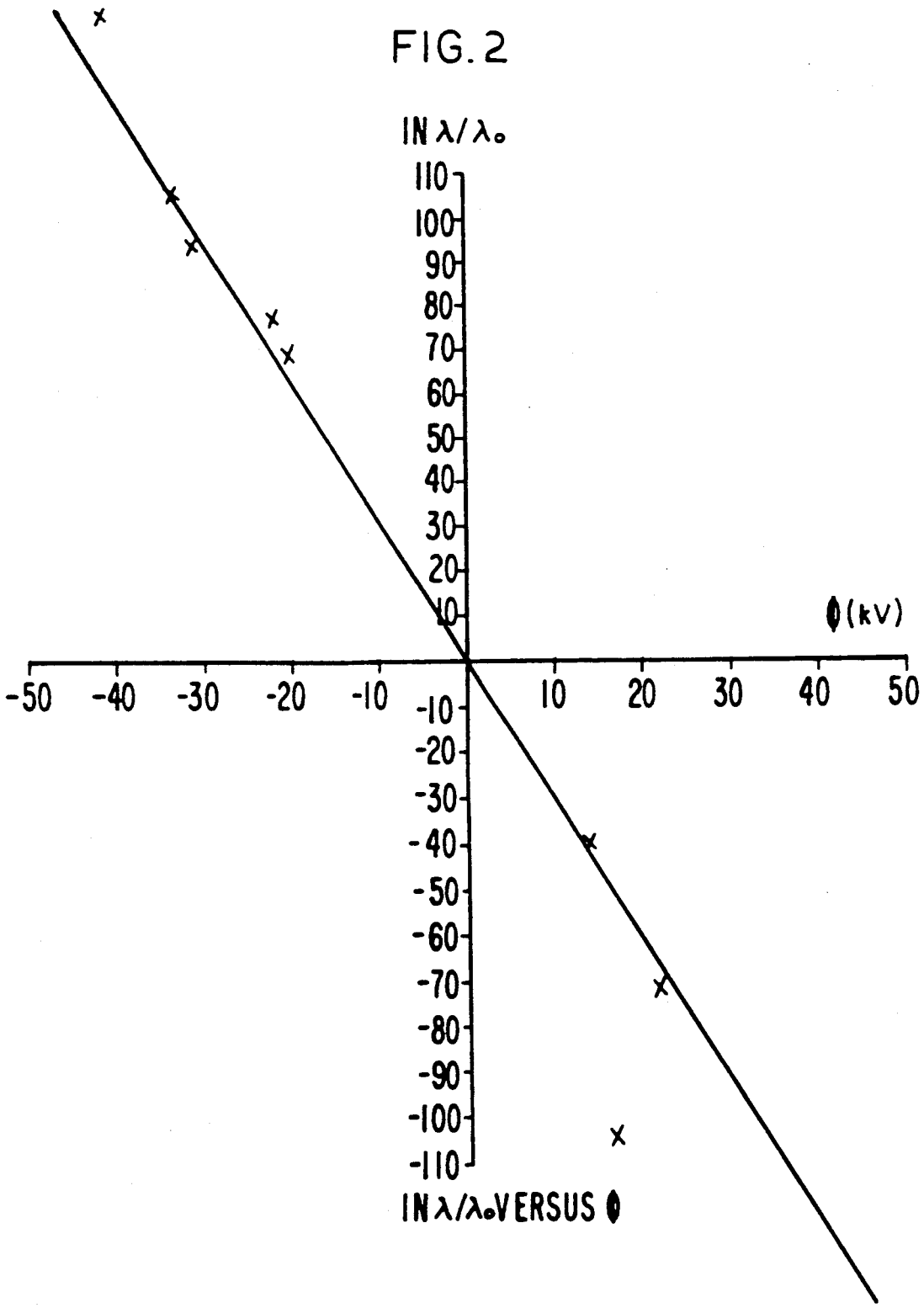
FIG. 2 is a graphic view of the test results using the apparatus of FIG. 1.

Table 1 shows, for thorium 230, theoretical and measured values of enhancement versus the potential of the generator 10. FIG. 2 shows a plot of the values set forth in Table 1, and the straight line in FIG. 2 is theoretical value, the data points showing the agreement between the theoretical and experimental values within experimental errors.

The enhancement values have a standard deviation of about five percent. Each point on the graph is represented by about 20 readings. The voltage reading are accurate to 1.8 kv. The principal experimental difficulty was in measuring the voltage of the generator, Some of the values of $1\eta\lambda/\lambda_o$ values were much too large. These values were attributed to errors in calculating the magnitude of the voltage. Such a value is shown by a data point is denoted by an asterisk in Table 1.

TABLE 1

Theoretical and measured values $\epsilon$ vs $\phi$ for Thorium 230

| $\phi$ in kv | $\epsilon$th | $\epsilon$m | % difference |
|---|---|---|---|
| | Negative voltages | | |
| −3.94 | 0.13 | 0.15 | 13.3 |
| −9.37 | 0.34 | 0.42 | 25.0 |
| −18.8 | 0.80 | 0.91 | 13.8 |
| −21.9 | 0.99 | 1.13 | 14.1 |
| −30.0 | 1.56 | 1.55 | 0.64 |
| −33.0 | 1.81 | 1.80 | 0.52 |
| −42.3 | 2.77 | 3.14 | 13.4 |
| | Positive voltages | | |
| +13.3 | −.341 | −0.310 | 9.1 |
| +14.8 | −0.370 | −0.652 | 76.2* |
| +22.6 | −0.508 | −0.494 | 2.76 |

The mineral pitchblende consists of about 70% uranium oxide and about 7% thorium oxide with lesser amounts of several stable oxides. Natural uranium is primarily uranium 238. At two generator speed settings, the activity increased appreciably as was expected. At $\phi=-22.6$kv, $\lambda/\lambda_o$ equals $1.97\pm0.37$. Within experimental error, this agrees with the theoretical value of 2.35. The large range for the measured $\lambda/\lambda_o$ is due to the fact that the activity at $\phi=0$ was only 2.23 times the background count.

Cesium 137 decays by beta emission to Ba 137, which is stable with a half-life of 30.2 years. A change in $\lambda$ was detected as the applied voltage of the generator 10 was turned on. The magnitude of the effect was much smaller. The foregoing description relates to the decontamination or enhancement of the decay rate of a radioactive material. A typical potential or voltage value for such enhancement is in the range of 40 to 50 kilovolts and a typical radioactive material suitable for showing enhancement is thorium 230.

The ignition can be accomplished by a Van de Graaff generator 10 in which the radioactive source 15 is within or on the sphere 13 of the generator. A typical voltage is 350 kilovolts, and the ignition time is typically one hour.

An initial ignition voltage of about 300 kilovolts for a period one hour may well be sufficient for igniting a nuclear fuel rod in the sphere of the generator. If necessary, a second ignition step may be used to complete the decontamination process.

The mechanism for alpha depletion differs from the mechanisms for beta and gamma depletion which are slower. In alpha depletion, the Coulomb barrier is $2Z_1e^2/r$ is modified by a constant term that is: $2Z_1e^2/r-2e\phi$. Variations are present but they are not as significant as the constant term. Here $\phi$ is the applied voltage on the generator terminal. $ln\lambda/\lambda_o=3.71Z_1(1/E^{\frac{1}{2}}-1/(E+2e\phi)^{\frac{1}{2}})$. Here p80 equals the decay rate and $\lambda_o$ equals the quiescent decay rate. $Z_1$ is the charge of the daughter nucleus and E is equal to the alpha decay energy.

The mechanism for beta decay involves contact between the electrons and the nucleus. This is a short range not a long range interaction. In the decay of thorium 234, the electrons which make contact with the nucleus are the S electrons. They have zero angular momentum. Thorium has the same number of S electrons as uranium, namely 14. In thorium, there are 76 electrons in the g, d and f angular momentum states. They do not contribute as much to the beta decay as do S electrons. The half-life is 24 days.

To achieve ignition of the radioactive materials, all that is needed is some mechanism to excite the charged particles. The following technique is suitable:

1. Place a sample in contact with a Van de Graaff generator operating at a modest voltage for 10 or 15 minutes.

On large samples the Van de Graaff generator is a most effective source for establishing the ignition. It establishes a voltage throughout the entire sample.

Gamma decay enhancement, like alpha decay enhancement, is long range but there is no Coulomb barrier to magnify the effect. All nuclei change their shapes from spherical to ellipsoidal etc. Gamma radiation occurs as a result of the oscillations of the protons and neutrons in the nucleus.

Tests were conducted to show that a positive or negative voltage on a Van de Graaff generator accelerates beta and alpha decay. One beta and two alpha emitters were placed inside the generator sphere, charged to a voltage of 350+75 kv, for a period of twelve hours. When the voltage was switched off, the measured activity oscillated through substantial variations. After three days the measured depletion was about 1% for Tl 204, about 7% for Po 210 and about 2.6% for Th 230. After seven days, the depletion had increased to about 5.3%, about 55.3% and about 81.8%, respectively. It is expected that the depletion will continue to background for all three sources within about 60 days.

A depletion "burn" can be initiated in an alpha emitter with a Van de Graaff voltage of about −50 kv in a time interval of 20 minutes or so. The alpha depletion is primarily due to the alpha excitation $2e\phi$.

The test procedure was as follows:

Three radioactive sources: Tl 204, a beta emitter and Th 230 and Po 210, both alpha emitters, were put inside the terminal of a Van de Graaff generator. The voltage was left on for 12 hours of consecutive running time. The quiescent activity $A_o$ of each source was measured before insertion. Shortly after the generator was turned off, the activity was monitored with a Geiger-Meuller counter. All three samples exhibited oscillations in the counting rate similar to that of a weakly damped harmonic oscillator. The oscillations continued for more than two weeks, indicating that the new quiescent value of $A_1$ was close to background.

The generator was operated at about ¾ maximum speed. The generator was kept away from nearby conductors, which might draw off the charge. The voltage was measured by observing the spark gap distance. These varied from as low as 6 inches (150 kv). The average terminal voltage was estimated to have been (350±75) Kv. In ln Coulomb barrier modification, a voltage of 412.5 kv is much more effective in enhancing alpha decay than a voltage whose magnitude is 62.5 kv less. This is because $\lambda/\lambda_o$ depends on $\phi$ exponentially.

Tl 204 decays by beta minus emission to Pb 204, a stable isotope, with a half-life of 3.8 years. The corresponding decay rate $\lambda=5.78\times10^{-9}$ sec$^{-1}$. The quiescent depletion of Tl 204 in a period of seven days is $$D_o=\lambda_o t=0.349\%$$

Measured values for $A_o$ and A after seven days were found to be $$A_o=673.9\pm0.11c/s \text{ and}$$

$$A=638.0\pm4.2c/s$$

The depletion or decontamination at this time was $$D=(A_o-A)/A_o=5.33\%$$

This is 15 times $D_o$. Three hours and 30 minutes later the measured activity, A, was 4.47% higher than $A_o$. The Tl 204 sample was provided by the Nucleus Inc., Oak Ridge, Tenn. It was housed in a plastic holder.

In the theory of beta decay the rate of decay is proportional to the electron charge density at the nucleus $\rho(o)=e\psi^*\psi(o)$. A negative voltage $\phi$ decreases the potential energy of th atomic electron and vice versa. This displaces the electron cloud away from the nucleus, increasing $\rho$(o). During the operation of the Van de Graaff, with the source inside the terminal, $\rho(o,\phi)$ has a steady state value.

Polonium 210 decays by alpha emission to Pb 206, a stable isotope with a half-life of 138.4 days. The corresponding decay rate if $\lambda_0=5.80\times10^{-8}$/sec. The decay energy is E=5.40 MeV. The quiescent depletion of Po 210 in seven days is $$D_o=\lambda t=3.51\%$$

The measured values for $A_o$ and A after seven says were $$A_o=332.13\pm1.52c/s$$

The depletion at this time was $$D=(A_o-A)/A_o=53.86\%$$

This is about 15.3 times $D_o$. Twelve hours later the measured activity A was 200 c/s, 30% lower than $A_o$. The oscillating period for this sample of $A_o$ is about one day.

The alpha depletion studies on Po 210 indicate that there is one significant mechanism which modifies the Coulomb barrier. This effect is described by Eq. (5) above where $V_a$ represents an increase in the alpha particles potential energy when the Van de Graaff voltage $\phi$ is negative and vice versa.

Thorium 230 decays by alpha emission to Ra 226 with a decay energy of 4.767 MeV. The half-life is 80,000 years. There are about a dozen daughters in the Th 230 decay scheme. The first daughter Ta 226 is an alpha emitter with a half-life of 1,600 years. The successive daughters are short half-life alphas and betas. The chain proceeds to Pb 210, which decays by alpha and beta emission with a half-life of 21 years. Subsequent daughters lead to $Po^{210}$ and then to Pb 206, a stable isotope.

The quiescent decay constant for Th 230 is $$\lambda_o = 2.75 \times 10^{-13}/\text{sec}$$

The quiescent depletion in seven days is:

$$D_o = \lambda t = 1.66 \times 10^{-5} T$$

Our measured values for $A_o$ and $A_1$, after days, were $$A_o = 91.47 \pm 4.57 c/s$$

$$A = 16.85 \pm 0.04 c/s$$

The depletion at this time was $$D = (A_o - A)/A_o = 81.22\%$$

This is $4.89 \times 10^4$ times greater than $D_o$. Sixteen hours later the measured activity A = 24.64 c/s, an increase of 46% over our earlier low count, but substantially less than $A_o$.

The fact that the depletion rate is much faster in Po and Th than in Tl is understandable. The beta decay process involves electron-nuclear contact $e\psi^*\psi(o)$ which is measured by the steady state and transient behavior of the atomic electron cloud. The alpha decay process is controlled by the Coulomb barrier, as modified. A small change in the charged density of the atomic electrons has a magnified effect on the decay rate.

The Van de Graaff voltage $\phi$ ignites radioactive waste. If the burn is going too slowly, re-ignite with an $e\phi\Delta t$ less than the initial value. High voltages may be hazardous. For example. $\phi = 2$ MV predicted to convert the half-life of $U^{238}$ to one second. Before initiating a decontamination procedure, the composition of the fuel should be determined.

| | DECAY STEP | HALF LIFE ($t_{\frac{1}{2}}$) |
|---|---|---|
| | DECAY OF CHAIN OF URANIUM 235 | |
| (1) | $_{92}U^{235} \rightarrow {}_{90}Th^{231} + \alpha$ | $7.13 \times 10^8$ years |
| (2) | $_{90}Th^{231} \rightarrow {}_{91}Pa^{231} + \beta -$ | 25.6 hours |
| (3) | $_{91}PA^{231} \rightarrow {}_{89}Ac^{227} + \alpha$ | $3.25 \times 10^4$ years |
| (4) | $_{89}Ac^{227} \rightarrow {}_{90}Th^{227} + \beta -$ | 21.6 years |
| (5) | $_{90}Th^{227} \rightarrow {}_{88}Ra^{223} + \alpha$ | 18.5 days |
| (6) | $_{88}Ra^{223} \rightarrow {}_{86}Rn^{219} + \alpha$ | 11.43 days |
| (7) | $_{86}Rn^{219} \rightarrow {}_{84}Po^{215} + \alpha$ | 4.0 seconds |
| (8) | $_{84}Po^{215} \rightarrow {}_{82}Pb^{211} + \alpha$ | $1.78 \times 10^{-3}$ seconds |
| (9) | $_{82}Pb^{211} \rightarrow {}_{83}Bi^{211} + \beta -$ | 36.1 minutes |
| (10) | $_{83}Bi^{211} \rightarrow {}_{81}Tl^{207} + \alpha$ | 2.15 minutes |
| (11) | $_{81}Tl^{207} \rightarrow {}_{82}Pb^{207} + \beta -$ | 4.78 minutes |
| | $_{82}PB^{207}$ is stable. | |
| | DECAY OF CHAIN OF URANIUM 238 | |
| (1) | $_{92}U^{238} \rightarrow {}_{90}Th^{234} + \alpha$ | $4.51 \times 10^9$ years |
| (2) | $_{90}Th^{234} \rightarrow {}_{91}Pa^{234} + \beta -$ | 24.1 days |
| (3) | $_{91}PA^{234} \rightarrow {}_{92}U^{234} + \beta -$ | 6.66 hours |
| (4) | $_{92}U^{234} \rightarrow {}_{90}Th^{230} + \alpha$ | $2.48 \times 10^5$ years |
| (5) | $_{90}Th^{230} \rightarrow {}_{88}Ra^{226} + \alpha$ | 80.0 years |
| (6) | $_{88}Ra^{226} \rightarrow {}_{86}Rn^{222} + \alpha$ | 1622 years |
| (7) | $_{86}Rn^{222} \rightarrow {}_{84}Po^{218} + \alpha$ | 3.823 days |
| (8) | $_{84}Po^{218} \rightarrow {}_{82}Pb^{214} + \alpha$ | 3.05 minutes |
| (9) | $_{82}Pb^{214} \rightarrow {}_{83}Bi^{214} + \beta -$ | 26.8 minutes |
| (10) | $_{83}Bi^{214} \rightarrow {}_{84}Po^{214} + \alpha$ | 19.7 minutes |
| (11) | $_{84}Po^{214} \rightarrow {}_{82}Bi^{210} + \beta -$ | 164 seconds |
| (12) | $_{82}Pb^{210} \rightarrow {}_{83}Bi^{210} + \beta -$ | 21 years |
| (13) | $_{83}Bi^{210} \rightarrow {}_{84}Po^{210} + \beta -$ | 5.0 days |
| (14) | $_{84}Po^{210} \rightarrow {}_{82}Pb^{206} + \alpha$ | 138.4 days |
| | $_{82}Pb^{206}$ is stable | |
| | DECAY CHAIN OF PLUTONIUM 239 | |
| (1) | $_{94}Pu^{239}\ {}_{92}U^{235} + \alpha$ | 24,360 years |
| | Then follow decay chain for Uranium 235. | |

I claim:

1. A method for enhancing alpha decay in radioactive materials comprising:

placing a mass of radioactive material in a space;

applying a negative electrostatic potential to said space containing said mass of radioactive material; and maintaining said electrostatic potential thereby increasing the radioactive decay of said radioactive material wherein the electrostatic potential is in the range of 50 kilovolts to 500 kilovolts.

2. A method as in claim 1, wherein said radioactive material includes at least one material in the uranium 235 decay chain.

3. A method as in claim 1, wherein said radioactive material includes at least one material in the uranium 238 decay chain.

4. A method as in claim 1, wherein said radioactive material includes at least one material in the plutonium 239 decay chain.

5. A method as in claim 1, wherein the electrostatic potential is maintained at least 30 minutes.

* * * * *